US005262010A

United States Patent [19]

Bubik et al.

[11] Patent Number: 5,262,010

[45] Date of Patent: Nov. 16, 1993

[54] DEWATERING DEVICE WITH ADJUSTABLE FORCE ELEMENTS FOR THE WEB-FORMING SECTION OF A PAPERMAKING MACHINE

[75] Inventors: Alfred Bubik; Otto Hildebrand, both of Ravensburg, Fed. Rep. of Germany

[73] Assignee: Sulzer Escher Wyss GmbH, Ravensburg, Fed. Rep. of Germany

[21] Appl. No.: 846,477

[22] Filed: Mar. 6, 1992

[30] Foreign Application Priority Data

Mar. 9, 1991 [DE] Fed. Rep. of Germany ..... 4107653

[51] Int. Cl.[5] ..... D21F 1/54

[52] U.S. Cl. ..... 162/352; 162/301; 162/354

[58] Field of Search ..... 162/301, 352, 374, 300, 162/354, 273

[56] References Cited

U.S. PATENT DOCUMENTS

| | | | |
|---|---|---|---|
| 3,585,105 | 6/1971 | Stuebe | 162/352 |
| 4,523,978 | 6/1985 | Pullinen | 162/352 |
| 4,648,943 | 3/1987 | Malashenko et al. | 162/352 |
| 4,988,408 | 1/1991 | Evalahti | 162/352 |
| 5,061,347 | 10/1991 | Bubik et al. | 162/301 |

FOREIGN PATENT DOCUMENTS

| | | | |
|---|---|---|---|
| 672390 | 10/1963 | Canada | 162/352 |
| 0251779 | 1/1988 | European Pat. Off. . | |
| 0306759 | 3/1989 | European Pat. Off. . | |
| 0416219 | 3/1991 | European Pat. Off. . | |
| 3315023 | 11/1983 | Fed. Rep. of Germany . | |
| 3153305 | 10/1986 | Fed. Rep. of Germany | 162/301 |
| 3628282 | 2/1988 | Fed. Rep. of Germany . | |
| 3929265 | 3/1991 | Fed. Rep. of Germany . | |
| 69885 | 12/1985 | Finland | 162/352 |
| 2069896 | 3/1987 | Japan | 162/300 |
| 672155 | 10/1989 | Switzerland . | |
| 1225517 | 3/1971 | United Kingdom . | |

*Primary Examiner*—Karen M. Hastings
*Attorney, Agent, or Firm*—Sandler Greenblum & Bernstein

[57] ABSTRACT

A dewatering device for the web-forming or wet section of a papermaking machine comprises foils arranged transverse to a forming wire, that is to say, extend in the cross-machine direction. Force or powering elements act upon the foils so as to exert a force or pressure upon the forming wire, and thus, bring about dewatering and sheet formation of a layer of fiber stock suspension reposing upon the forming wire. The force elements are constructed and positioned such that additional moments are generated which counteract tilting moments produced by the frictional force present between the foils and the forming wire. In certain arrangements, the force elements also can be interconnected with one another.

19 Claims, 5 Drawing Sheets

PW
4
A
1
4'
3
DD
8a
4'
8
5'
100
5
100
5
6
2
7
6
2
20

DD
8b
5'
1
5
8'

A
3
1
1
DD
8
2
8''
2

A
3
DD
1

8
21
21
2
20
A
3

1
DD
8
22
22
2
A
DD
2

A
3

1
15
15
DD
2
7
A
3
15

DD
2
7

Fig- 13b
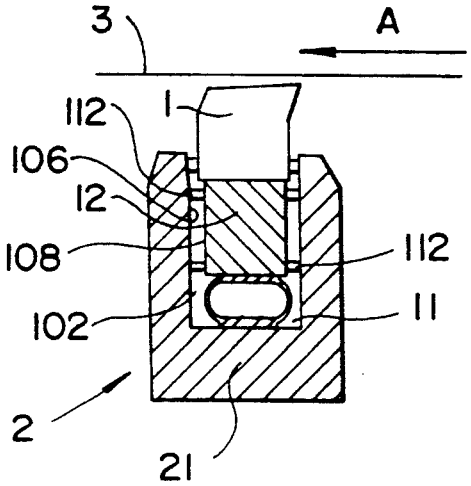
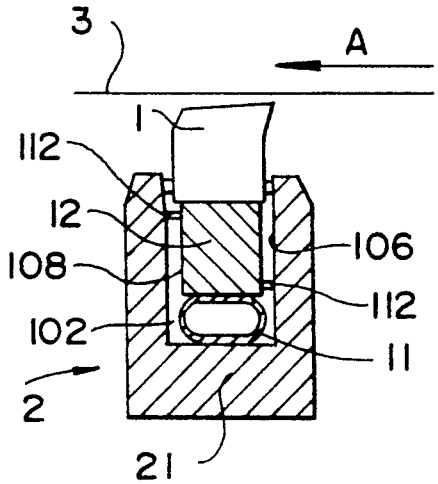
Fig- 13a
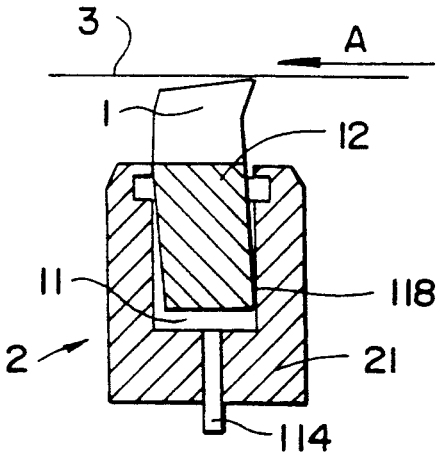
Fig- 14a

Fig- 17
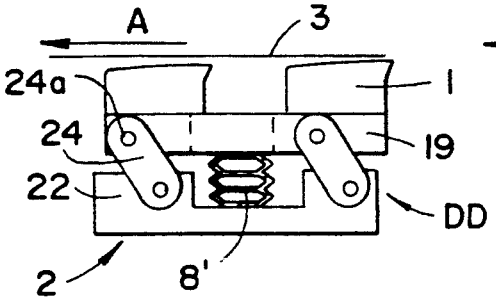
Fig- 18
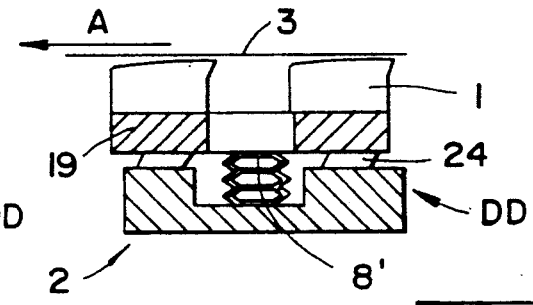
Fig- 19
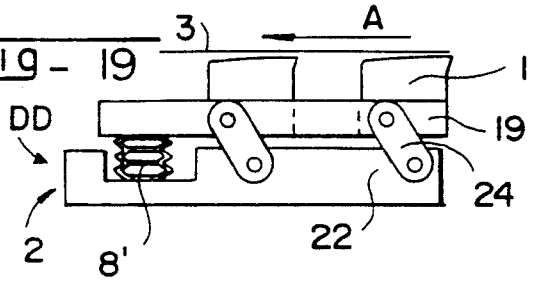
Fig- 22
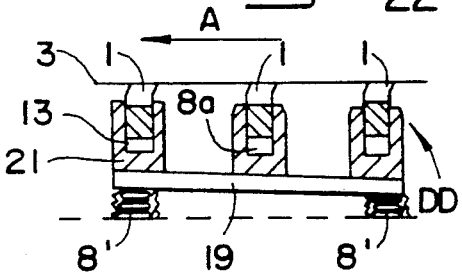
Fig- 20
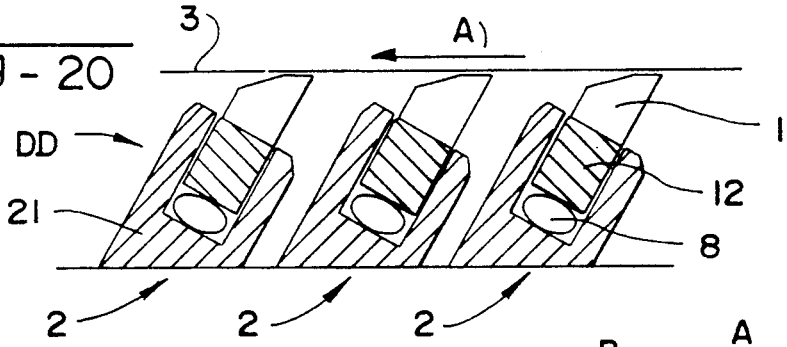
Fig- 21
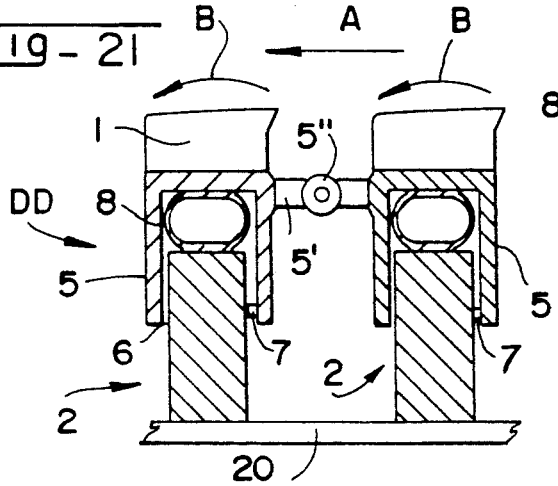
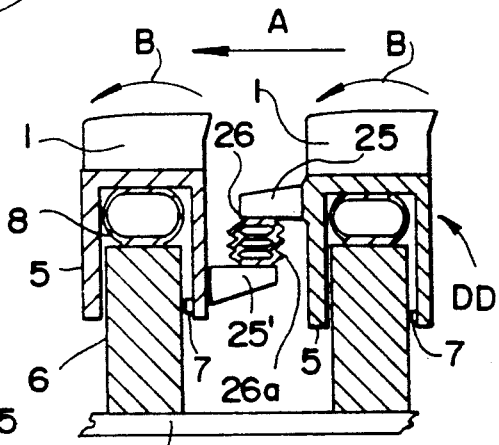
Fig- 23

DEWATERING DEVICE WITH ADJUSTABLE FORCE ELEMENTS FOR THE WEB-FORMING SECTION OF A PAPERMAKING MACHINE

BACKGROUND OF THE INVENTION

1. Field of the Invention

The present invention relates to a new and improved dewatering device for the web-forming or wet section of a papermaking machine.

Generally speaking, the dewatering device for the web-forming or wet section of a papermaking machine according to the present invention is of the type comprising foils or strips or ledges disposed transverse to a predetermined direction of travel of the forming wire or sieve, that is to say, the foils extend in the cross-machine direction. These foils are individually adjustable or else adjustable in groups or sets in the direction of the forming wire. Through the use of force or powering elements for the foils there can be exerted, by means of the foils, a predetermined or desired force or pressure action upon the forming wire, especially for the dewatering and formation of the paper web or sheet formed of fiber stock suspension which is located upon the forming wire.

2. Discussion of the Background and Material Information

Dewatering devices of this type can be constructed, for instance, in the manner disclosed in the commonly assigned German Patent Publication No. 3,929,265, published Mar. 28, 1991. This published German document teaches the possibility of rendering foils individually adjustable, in order to be able to adjust or set their position and to exert a force upon the forming wire as a function of prevailing requirements. Depending upon the operating conditions under which these foils are used, particularly when there are required considerable adjustment distances through which the foils must be moved, it can happen, however, that these foils experience undesired seizing and bending. One of the main reasons that this occurs is attributable to the fact that frictional forces arise at the location where the foils come into contact with the traveling forming wire. By virtue of the prevailing lever action these frictional forces produce a moment which must be taken up by the guides of the foil adjustment mechanism, and hence, there can result the aforenoted foil seizure or binding and foil bending. Since at this location of the papermaking machine high precision settings and regulation operations must be carried out, appreciable drawbacks arise during the manufacture of high-quality paper sheets or webs when the foil adjustment mechanism operates inaccurately.

Other dewatering devices are also known in this technology wherein a multiplicity of foils or ledges are mounted at a frame and this frame can be pressed against the forming wire of the papermaking machine through the use of appropriate force or powering elements. While such systems can be rather easily constructed such that the foils do not seize or clamp, nonetheless there is here not possible individual adjustment or setting of the foils.

SUMMARY OF THE INVENTION

Therefore, with the foregoing in mind, it is a primary object of the present invention to provide an improved dewatering device for the web-forming or wet section of a papermaking machine which is not afflicted with the aforementioned shortcomings and drawbacks of the prior art.

Another and more specific object of the present invention aims at the provision of an improved dewatering device for the web-forming or wet section of a papermaking machine by means of which there can be undertaken an exceedingly accurate individual adjustment of the foils as well as a precise adjustment of such foils throughout their required adjustment path, so that such foils do not tend to clamp or seize.

Still a further noteworthy object of the present invention concerns the provision of an improved dewatering device for the web-forming or wet section of a papermaking machine which is quite economical to fabricate, not readily subject to breakdown or malfunction, extremely reliable in operation, and enables formation of a high-quality paper web or sheet at the web-forming section of the papermaking machine in an efficient and accurate manner.

Now in order to implement these and still further objects of the present invention, which will become more readily apparent as the description proceeds, the dewatering device for the web-forming or wet section of a papermaking machine of the present development is manifested, among other things, by the features that the force elements are constructed and positioned such that these force elements can produce additional moments capable of counteracting tilting moments exerted by the frictional forces present between the foils and the forming wire.

By virtue of the foregoing, there is achieved the beneficial result that the unavoidable tilting moments are introduced into the force elements, so that such force elements not only generate the required contact or pressing forces for the foils or strips at the forming wire, but when constructing the dewatering device according to the teachings of the present invention, these force elements can take up such tilting moments. As a result, there is avoided the clamping or seizing of the foil guides which enable movement of the foils towards and away from the forming wire. The force elements can be constructed such that sufficient space is available therebetween in order to be able to rapidly remove the water collected at this location and with minimum hinderance.

It is here noted that the present invention envisages that the moment which counteracts the tilting moment can be produced by adjustable force or powering elements successively or tandemly arranged in the direction of travel of the forming wire.

According to a further aspect, the present invention contemplates that a plurality of the foils secured at supports or support members extending transverse to the direction of travel of the forming wire are assembled together into a group or set. These supports are displaceably guided at guide members. At the region of at least one of the guide members there is provided an abutment or stop or support element, which is movable in the direction of the forming wire, for the forces acting in the direction of travel of the forming wire. The supports are mechanically interconnected by rigid coupling or connection elements. These supports and coupling or connection elements are constructed such that they provide an adequate amount of free space for the throughflow of water passing through the forming wire.

Still further, the supports or support members can be mechanically interconnected by coupling or connection elements provided with pivots or hinges. Here too, these supports and coupling or connection elements are constructed such that they provide an adequate amount of free space for the throughflow of water passing through the forming wire.

A group or set of conjointly adjustable or settable foils can comprise, for example, two, three or four foils. Therefore, due to the grouping or assembly together of a relatively small number of individual foils there are present sufficient possibilities for the individual adjustment of the individual foils towards the forming wire.

The present invention further proposes that at least one force element comprises a force-generating source or device filled or fillable with a suitable pressurized fluid medium, such as water or air. The force applied by the force-generating source in the direction of the forming wire can be adjusted or regulated by the pressurized fluid medium.

The force-generating sources can be constructed and arranged such that the forces applied by the same are directed towards the forming wire and opposite to the direction of travel of the forming wire, so that the forces effective in the travel direction of the forming wire are at least partially taken up.

Furthermore, the cross-sectional configuration of the force-generating elements can be of elongated expanse or extended shape in the direction of travel of the forming wire.

It is possible, according to a further feature, to apply the moment which counteracts the tilting moment by relatively low-friction guides or guide elements successively arranged in the direction of travel of the forming wire.

Moreover, the force element of an associated foil or forming foil can comprise a force-generating source arranged in a compartment or chamber. This force source acts upon a displacement or movable element guided in an associated transverse support or support member. This displacement element carries the foil and is shiftable in the direction of the forming wire. Moreover, a friction-reducing medium can be provided between a wall of the compartment or chamber and the displacement element. In this arrangement, the compartment or chamber can be advantageously supplied with a suitable fluid medium, especially water, for flushing the associated foil.

As an alternative arrangement, each force element of an associated foil or forming foil can comprise a compartment or chamber which is filled or fillable with a suitable pressurized fluid medium. The cross-section of such compartment or chamber can possess an extended or prolonged expanse in the direction of travel of the forming wire. The displacement element is inserted into the compartment or chamber. This displacement element carries the associated foil, is guided in a transverse support or support member, and is shiftable in the direction of the forming wire. Moreover, such displacement element closes the compartment or chamber. Also, in this arrangement, the compartment or chamber can be supplied with a suitable fluid medium, again especially water, for flushing the associated foil.

As to a further aspect of the present invention, the rear wall of the force-generating source, as viewed with respect to the direction of travel of the forming wire, can be constructed such that, during operation of the dewatering device, this rear wall produces a stronger force in the direction of the forming wire as other more forwardly situated regions of such force-generating source.

It is furthermore contemplated for the force element of a foil or forming foil to be provided with at least two force-generating sources which are capable of producing forces of different magnitude. The applied force of each of these at least two force-generating sources is in the direction of the forming wire. Moreover, these at least two force-generating sources are successively arranged as viewed with respect to the direction of travel of the forming wire.

As a further possibility, it is contemplated that when there are used at least two force-generating sources for each foil or forming foil, one of these force-generating sources has a direction of the applied force which does not extend towards or not directly towards the forming wire and can be shifted in the direction of the forming wire. Still further, one of these force-generating sources can have a direction of the applied force which does not extend towards the forming wire and can be freely adjusted in the direction of the forming wire.

It is also possible for the force element of a foil to be provided with only one force-generating source, the applied force of such single force-generating source is in the direction of the forming wire and, as viewed in the direction of travel of the forming wire, is located behind or downstream of the point of application of the force of the associated foil.

Still further, the counteracting moment can be produced by a lever extending in or opposite to the direction of travel of the forming wire, the foil or foils being secured at such lever, and force-generating sources act upon the lever.

According to a still further construction, the counteracting moment can be produced by force elements operatively engaging with a frame member provided with a group of the foils, and at least two of these force elements are arranged in succession as viewed with respect to the direction of travel of the forming wire.

With reference to a still further possible embodiment, the counteracting moment can be produced by force elements operatively engaging with a frame member provided with a group of the foils and pivotable levers. In this arrangement, at least two of these pivotable levers are arranged in succession as viewed with respect to the direction of travel of the forming wire, and such pivotable levers allow for a substantially parallel movement between the frame member and the stand of the papermaking machine in the and opposite to the direction of travel of the forming wire.

According to a further aspect, the present invention contemplates that there are provided at least two supports or support members arranged in succession with respect to the direction of travel of the forming wire and which extend transverse to such direction of travel of the forming wire. At each such support or support member there is secured at least one foil. These supports are displaceably guided at guide members in the direction of the forming wire. At the region of at least one of the guide members there is provided an abutment or stop element, which is movable in the direction of the forming wire, for the forces acting in the direction of travel of the forming wire. Rigidly mounted levers are provided for the supports or support members, and such rigidly mounted levers extend substantially perpendicular to the direction of movement of these supports or support members. Between the rigidly mounted levers there is arranged at least one force-generating component or part, and such rigidly mounted levers are directed towards one another and offset from one another with respect to the direction of movement or displacement of the supports or support members.

Regarding the just-mentioned at least one force-generating component or part such can comprise a spring bellows by means of which, by virtue of different expansion thereof, there can be produced a predetermined or desired adjustable force in the direction of movement or displacement of the supports or support members.

Additionally, the present invention further contemplates to leave sufficient space or distance between the individual force elements such that the water passing through the forming wire can be withdrawn between the force elements at least partially throughout the entire cross-machine direction of the papermaking machine.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference numerals to denote the same or analogous elements or components, and wherein:

FIGS. 2 to 23 depict in respective fragmentary partial sectional views different exemplary embodiments of dewatering devices for the web-forming or wet section of a papermaking machine constructed according to the present invention.

DETAILED DESCRIPTION OF THE PREFERRED EMBODIMENTS

Figure 1:
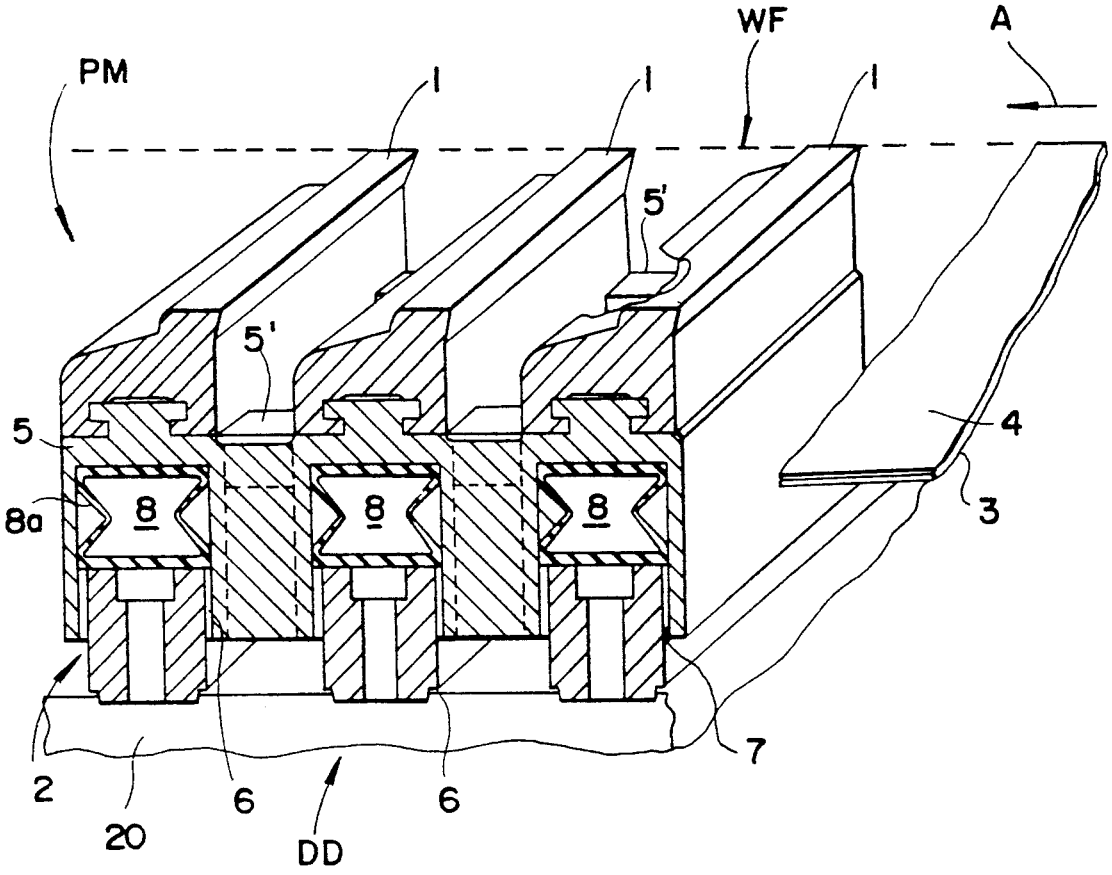
FIG. 1 is a fragmentary partial sectional view of a dewatering device for the web-forming or wet section of a papermaking machine constructed according to the present invention.

Describing now the drawings, it is to be understood that only enough of the construction of the different exemplary embodiments of dewatering devices DD for the web-forming or wet section WF of a papermaking machine, merely generally represented by reference character PM, have been depicted therein, in order to simplify the illustration, as needed for those skilled in the art to readily understand the underlying principles and concepts of the present invention.

Turning now to the exemplary embodiment of FIG. 1, there is depicted therein a group of, for instance, three foils or strips or ledges 1 arranged beneath a travelling forming wire or sieve 3 moving through the web- or sheet-forming section WF of the papermaking machine PM. Of course, there can be provided a lesser or greater number of foils 1 in the group, such as, for example, two or four such foils 1 (see, for example, FIGS. 2 to 4 and 15). Upon the forming wire 3 there is supported a fiber layer or ply 4 from which there is formed a paper web or sheet, generally represented by reference character PW (see FIG. 2).

These three foils or forming foils 1 are pressed against the forming wire 3 by three associated force elements or foil powering elements or force means 2. These three force elements 2 are supported upon a frame or frame member 20 of the papermaking machine PM. Force sources or force-generating sources 8 are located within the related force or powering element 2. In the embodiment under consideration each such force source or force-generating source 8 may comprise, for instance, a hose or tube member 8*a* or equivalent structure filled or fillable with a suitable pressurized medium, for instance, water or air, which exerts the requisite force or pressure. The individual successively arranged foils 1 secured to foil supports or carriers 5 are here mechanically coupled with one another by, for example, rigid coupling or connection elements 5', which may be constituted, for example, by struts or webs 5*a* or equivalent connector structure. These coupling or connection elements 5' are spaced sufficiently apart from one another in the cross-machine direction to allow the water expressed through the forming wire 3 to be removed without hinderance.

Furthermore, it will be seen that the foil supports or carriers 5 are displaceably guided at guide elements or guides 6 for movement in the direction of or substantially perpendicular to the forming wire 3. At the movable foil supports or carriers 5 there are provided abutments or stop elements 7 extending in the cross-machine direction, for instance, substantially through the same distance as the length of the related foil 1 for taking up forces effective in the direction of travel or movement A of the forming wire 3. Since the abutments or stop elements 7 are here shown secured to the movable foil supports or carriers 5, such abutments or stop elements 7 are also movable in the direction of the forming wire 3.

During operation of the dewatering device DD, frictional forces present between the foils 1 and the forming wire 3 produce tilting moments, as indicated, for instance, in FIGS. 21 and 23 by reference character B, which are counteracted by the force elements or force means 2 which produce additional moments opposing or counteracting these tilting moments B.

Figures 2, 3, 4, 5, 6, 7, 8, 8A:
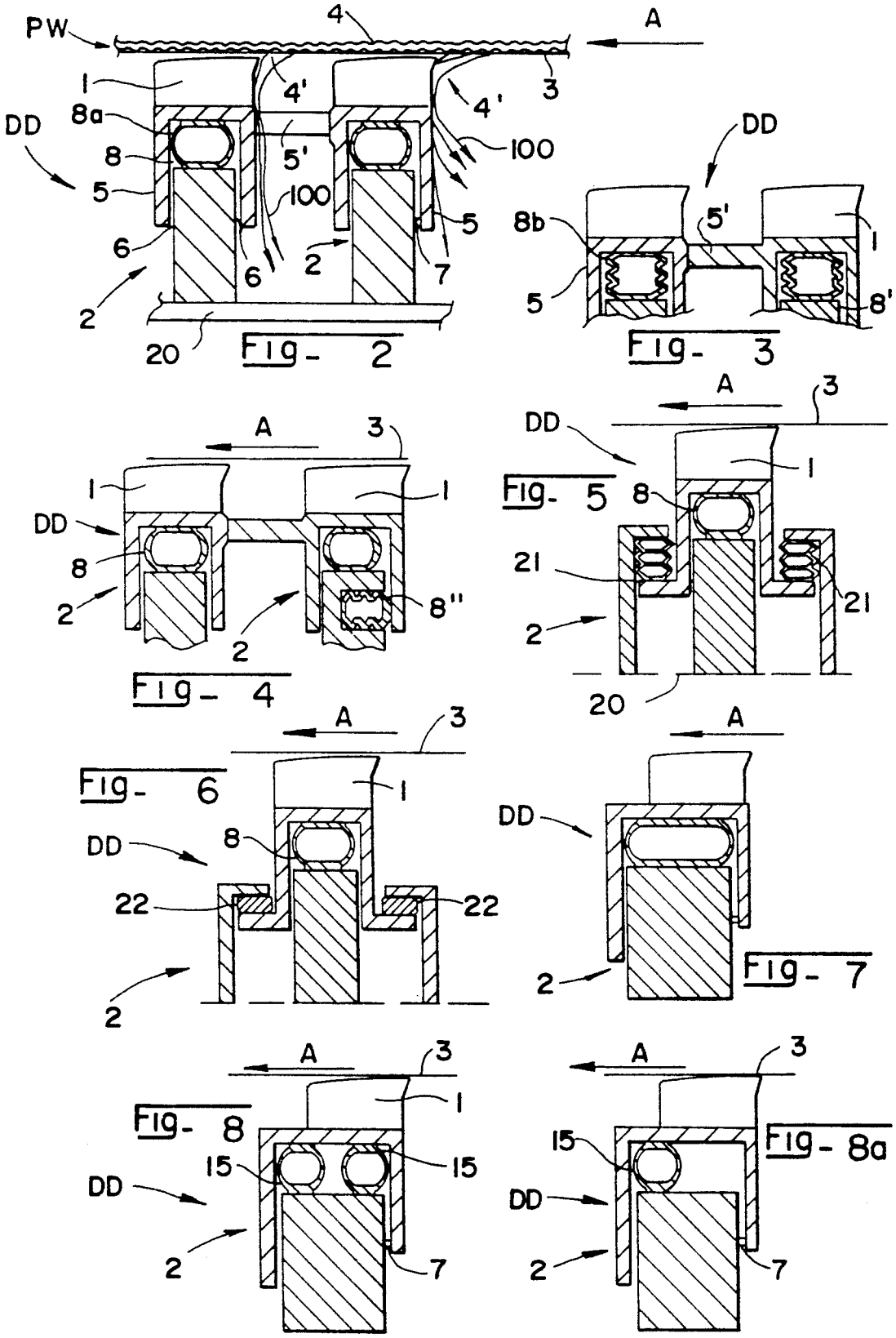

FIGS. 2 and 3 respectively illustrate similar dewatering devices DD like the embodiment of FIG. 1, wherein, here however, only two foils 1 are grouped together into a group or set. The force sources or force-generating sources 8 (FIG. 2) and 8' (FIG. 3) of the related force elements or foil powering elements 2, are constructed, for example, either as hose or tube members 8*a* (see FIG. 2) or bellows 8*b* (FIG. 3), which can be or are filled with a suitable pressurized medium as previously explained. In the embodiment of FIG. 2 there has been represented by the arrows 100 the water which is removed beneath the travelling forming wire 3 during operation of the dewatering device DD, whereas for purposes of simplification of the drawings such downward water removal has not been particularly illustrated in the other embodiments.

With reference now to the modified construction of dewatering device DD shown in FIG. 4, the force which is effective in the direction of travel A of the forming wire 3, can be taken up by an additional force source or force-generating source 8'' which can apply forces both in the direction of or substantially perpendicular to the forming wire 3 as well as in the direction opposite to the direction of travel A of such forming wire 3. The aforementioned force source or force-generating source 8'' in conjunction with the force source or force-generating source 8 located thereafter or downstream, as viewed with respect to the direction of travel A of the forming wire 3, can generate the counteracting moment.

The embodiments of FIGS. 5 and 6 depict, apart from the force sources or force-generating sources 8 for producing the forces required in the direction of the forming wire 3, respective additional force elements 21 and 22 which are effective in the opposite direction and by virtue of their spaced apart position, as viewed in the direction of travel A of the forming wire 3, can produce a moment. As a result, there is possible a specific adjustment of the angle of attack or contact angle of the foil 1 with respect to the forming wire 3.

Continuing, and with reference to the various further possible embodiments of dewatering devices DD respectively depicted in FIGS. 7, 8 and 8*a*, the desired angle of attack of the foil 1 with respect to the forming wire 3 and the required moment, can be realized by means of the depicted force sources or force-generating sources 10 and 15. This can be either accomplished by, as in FIG. 7, prolonging or extending the expanse of the single force source 10 in the direction of travel A of the forming wire 3, or, as shown in FIG. 8, through the use of two successively or tandemly arranged force sources 15 as viewed with respect to the direction of travel A of the forming wire 3, or still further, according to the embodiment of FIG. 8*a*, by means of a single force source 15 whose point of force application or point of action is located offset behind or downstream of the point of force application at the foil 1 as viewed with respect to the direction of travel A of the forming wire 3. Moreover, the embodiment of FIG. 8 affords a further advantage when both of the tandemly or successively arranged force sources 15 are supplied with different fluid medium pressures. As a result, the moment can be intentionally controlled and, when necessary, there can be produced a different angle between the foil 1 and the forming wire 3.

Figure 9:
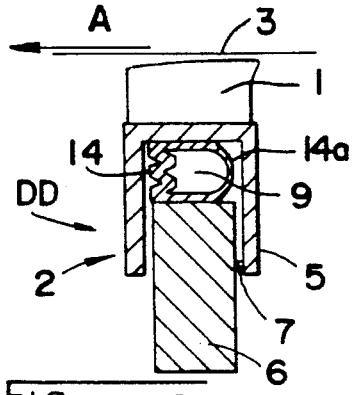

In the embodiment of FIG. 9 there is provided for solving the objectives of the present invention, a force source 9 having a rear wall 14 structured such that, during operation of the dewatering device DD, this rear wall 14 produces a more intensive force in the direction of the forming wire 3 in relation to the force produced by the more forwardly situated region or regions 14*a* of such force source 9. This rear wall 14 can have, as shown, a bellows-like or pleated structure.

Figure 10:
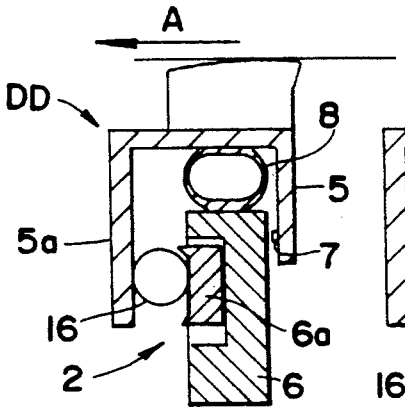

FIG. 10 depicts a further exemplary embodiment of dewatering device DD, wherein one of the force sources 16 is arranged between a leg 5*a* of the support or support member 5 and a slide 6*a* of the associated guide or guide member 5. This force source 16 has a force action which is not directed towards the forming wire 3 and the point of application of the force can be shifted in the direction of the forming wire 3, and thus, there can be adjusted the moment.

Figure 11:
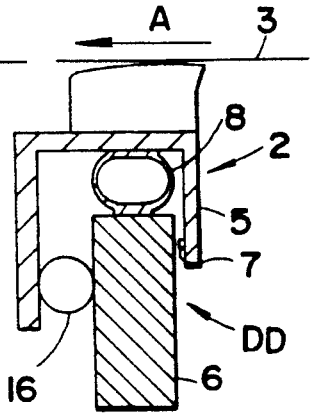

In contrast thereto, in the further embodiment of dewatering device DD depicted in FIG. 11, the force source 16 freely adjusts its position with respect to the forming wire 3.

Figure 12:
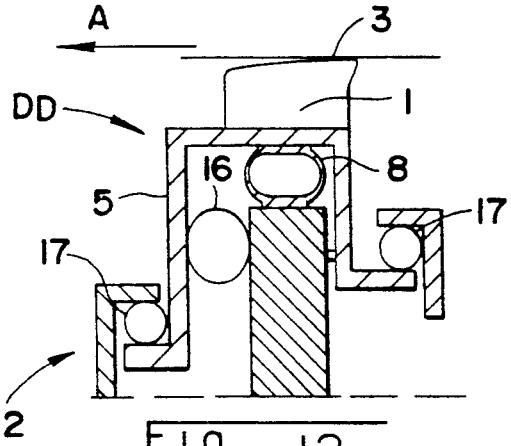

Regarding the embodiment of FIG. 12 such constitutes to a certain extent an improvement upon the embodiments of dewatering devices DD illustrated in FIGS. 10 and 11. Furthermore, this arrangement affords the possibility of adjusting or setting the angle between the top of the foil 1 and the forming wire 3. This is specifically possible by the provision of additional or supplementary force sources 17 which, as viewed in the direction of travel A of the forming wire 3, are arranged offset or positionally shifted with respect to the other force sources 8 and 16.

Figure 13:
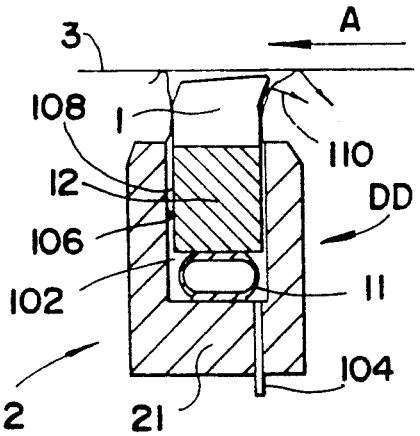

As to the force elements or foil powering elements 2 depicted in the various embodiments of FIGS. 13, 13*a*, 13*b*, 14, and 14*a*, the foils or strips 1 can be adjusted by displacement of displacement or movable elements 12 in the direction of the forming wire 3. These displacement elements 12 are guided in transverse support members 21 which essentially extend throughout the width of the papermaking machine PM, that is, in the cross-machine direction. In the embodiment of FIG. 13 there is used as the force-generating element a deformable hose or tube member 11 filled with a suitable pressurized fluid medium as previously explained. The chamber or compartment 102 housing the hose or tube member 11 flow communicates with an infeed or delivery line 104 which supplies a suitable fluid medium, such as water to this chamber or compartment 102 which lubricates the guide surfaces or walls 106 and 108 between the transverse support member 21 and the displacement element 12 so as to reduce the frictional forces. The infed water then can pass in the direction of the associated foil 1 between the outer wall 108 of the displacement or movable element 12 and the inner wall 106 of the chamber or compartment 102 and contacts such foil 1 for flushing and cleaning the same, as indicated by the arrows 110.

Figure 14:
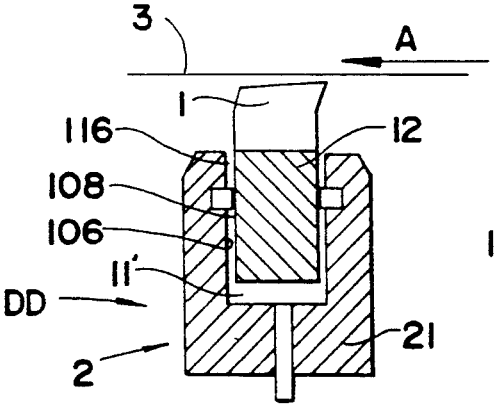

In the respective modified constructions of FIGS. 13*a* and 13*b*, friction reducing elements or low-friction guides 112, such as small roller-like elements formed of or coated with a low-friction material, such as "Teflon", can be successively arranged in the direction of travel A of the forming wire 3 between the outer wall 108 of the displacement or movable element 12 and the inner wall 106 of the chamber or compartment 102 housing the hoses 11 in order to promote the relative movement between the displacement or movable element 12 and the transverse support member 21 and for applying the moment which counteracts the tilting moment. 20 In the further embodiment of FIGS. 14 and 14*a*, there is used as the force-generating element a pressure chamber or compartment 11' flow communicating with a pressurized fluid medium infeed line or conduit 114. The guide surfaces or walls 106 and 108 between the transverse support member 21 and the displacement element 12, respectively, are lubricated by a suitable fluid medium which reduces frictional forces. For this purpose, it is conceivable to use water, supplied by the infeed or delivery line or conduit 114 to the pressure chamber or compartment 11' and which effluxes in a desired quantity from the guide gap or space 116 between the transverse support member 21 and the displacement element 12, and here also can be used for cleaning and flushing the related foil 1. FIG. 14 shows the rest position of the foil 1 and FIG. 14*a* its inclined position, during operation, when there is exerted the tilting moment. To facilitate sliding movement between the displacement or movable element 12 and the inner wall 106 of the transverse support member 21 bounding the pressure chamber or compartment 11' such inner wall can be coated with a low-friction material, such as "Teflon", as generally indicated by reference numeral 118.

Figure 15:
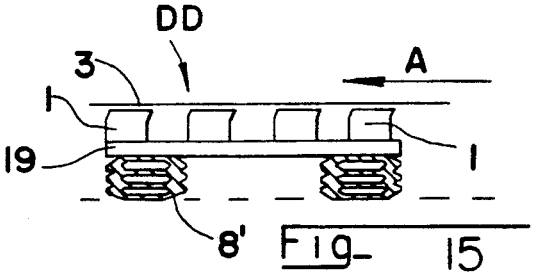
Figure 16:
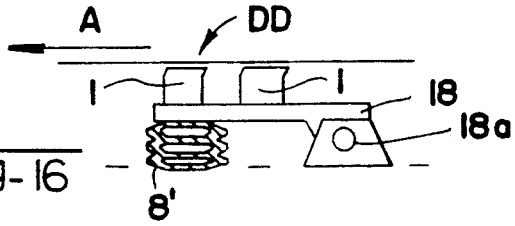

Further possible constructions of dewatering devices DD have been depicted in FIGS. 15 and 16, wherein a plurality of foils 1 are either mounted upon a frame member 19 supported at successively arranged force sources or force-generating sources 8' (FIG. 15) or upon lever members or levers 18 provided with hinges or pivots 18*a* and force sources or force-generating sources 8' (FIG. 16). These lever members or levers 18 extend in or opposite to the direction of travel A of the forming wire 3.

As depicted in the respective embodiments of FIGS. 17, 18 and 19, the movement and exact guidance of the foils 1 also can be accomplished by means of a frame member 19 guided in hinges or pivots 24a for movement essentially parallel to the forming wire 3. Furthermore, force sources or force-generating sources 8' which produce forces directed towards the forming wire 3 and successively arranged pivot levers or lever members 24 can take up the forces exerted in the direction of travel A of the forming wire 3 and the moments and can introduce such into the stand or framing 22 of the papermaking machine PM.

FIG. 20 illustrates that it is possible to devise a dewatering device DD capable of fulfilling the objectives of the present invention if the force elements 2 are positioned at an inclination. By virtue of these measures there can be taken up or absorbed the frictional forces transmitted to the foils 1 and moments resulting from such frictional forces.

For the embodiment of FIG. 20, there can be used an arrangement similar to that considered with regard to FIG. 13, wherein each force element 2 of an associated foil 1 can comprise a force source 8 installed in a chamber or compartment 120. This force source 8 acts upon an associated displacement element 12 guided in the related transverse support or support member 21. This displacement element 12 carries the foil 1 and is shiftable in the direction of the forming wire 3. Moreover, here also, a suitable friction-reducing medium can be employed between the wall of the chamber or compartment 120 and the displacement element 11. As an alternative construction, there can be used for the embodiment of FIG. 20, constructions and arrangements of the force elements 2 like those previously considered with regard to the heretofore described embodiments of FIGS. 13a, 13b, 14a and 14b.

As illustrated in the modified embodiment of FIG. 21, the coupling or connection elements 5' located between the foil supports 5, also can be provided with a pivot or hinge structure 5''. Notwithstanding the frictional moments B exerted at the foils or forming foils 1 during operation of the dewatering device DD, there is thus rendered possible a stable guiding of the foil supports 5 free of any binding or seizure since the frictional force moments produce counteracting forces at the pivot or hinge structure 5'.

With respect to the construction of dewatering device DD as depicted in FIG. 22, the foils 1 can be arranged, for instance, upon a frame or frame member 19 upon which act force sources 8'. Just like for the embodiments of FIGS. 13, 13a and 13b for instance, there can be here also provided an arrangement where each of the force elements or force means 2 of an associated foil 1 comprises displacement or movable elements 12 movable in the direction of the forming wire 3. These displacement elements 12 are guided in associated transverse support members 21 and there can be used as force source or force-generating source 13 for each of these force elements or force means 2 a deformable hose or tube member 8a filled with a suitable pressurized fluid medium as previously explained. As a result, with an approximately linearly increasing contact or pressing force in the direction of travel A of the forming wire 3, that is, with a greater force present in the supporting force sources 8' situated behind the frame 19, the frame 19 is adjusted at an acute angle with respect to the forming wire 3, as shown. The thus resulting unequal spacing between the frame 19 and the forming wire 3 can be easily compensated by the force sources 13.

With reference now made to the embodiment of FIG. 23, it is indicated that such arrangement enables an independent adjustment or setting of neighboring foils 1, since it is possible, through the use of a force-generating element 26, to produce a force which is essentially independent of distance. There are provided rigidly mounted levers 25 and 25' which extend substantially perpendicular to the direction of movement of associated supports or support members 5. Between such rigidly mounted levers 25 and 25' there is arranged the force-generating component or part 26. Furthermore, these rigidly mounted levers 25 and 25' are directed towards one another and are offset from one another with respect to the direction of movement or displacement of the supports or support members 5. Due to the provision of spaced apart levers or lever members 25 and 25' which are rigidly connected with neighboring foil supports or support members 5, this distance-independent force produces the desired supporting or counteracting moment or torque and at the same time allows for a change in position of the related foil 1 relative to the forming wire 3. Such measure can be beneficial in the here exaggerated depicted case of foil wear, but also in order to be able to provide a finer regulation of the contact or pressing force.

Regarding the just-mentioned at least one force-generating component or part 26 such can comprise a spring bellows 26a by means of which, by virtue of different expansion thereof, there can be produced a predetermined or desired adjustable force in the direction of movement or displacement of the supports or support members 5.

It is here importantly mentioned that even though for explanatory purposes the different embodiments of inventive dewatering device DD have been depicted in conjunction with foils or strips or ledges arranged substantially in horizontal direction in succession or tandem in the direction of travel A of the forming wire 3, other arrangements are readily possible, such as inclined or vertical, provided that the forming wire 3 is suitably guided. Moreover, it is to be appreciated that various features of the individual embodiments can be advantageously combined to create still further constructions of dewatering devices without departing from the spirit and scope of the present invention.

While there are shown and described present preferred embodiments of the invention, it is distinctly to be understood the invention is not limited thereto, but may be otherwise variously embodied and practiced within the scope of the following claims.

What is claimed is:

1. A dewatering device for the web-forming section of a papermaking machine, comprising:

a forming wire movable in a predetermined direction of travel;

a forming wire movable in a predetermined direction of travel;

a plurality of foils cooperating with the forming wire and disposed transverse to the predetermined direction of travel of the forming wire;

force elements provided for the foils for exerting, by means of the foils, a predetermined force upon the forming wire for the dewatering and formation of a paper web formed of fiber stock suspension which is located upon the forming wire, the force elements comprising adjustable force elements successively arranged in the predetermined direction of travel of the forming wire for producing the moments which counteracts the tilting moments;

the force elements being constructed and positioned such that the force elements produce additional moments counteracting tilting moments exerted by frictional forces present between the foils and the forming wire, including means for connecting together at least one plurality of only two, three or four of the plurality of foils into a foil group;

support members extending transverse to the predetermined direction of travel of the forming wire;

a predetermined number of the plurality of foils being arranged in succession in the predetermined direction of travel of the forming wire and secured at respective individual ones of the support members and assembled together to form said foil group;

guide members, each guide member structured for displaceably guiding a respective one of the support members in the direction of the forming wire;

an abutment element mounted on at least one of the support members and cooperating with at least one of the guide members and movable in the direction of the forming wire, said abutment element being structured and arranged for taking up forces acting in the predetermined direction of travel of the forming wire;

the means for connecting together at least one plurality of only two, three or four of the plurality of foils into a foil group comprising coupling elements for mechanically interconnecting the support members with one another; and said support members and said coupling elements being constructed such that there is provided a predetermined amount of free space for the throughflow of water passing through the forming wire.

2. The dewatering device for the web-forming section of a papermaking machine according to claim 1, wherein:

one of said force elements is provided for each respective one of said foils.

3. The dewatering device for the web-forming section of a papermaking machine according to claim 1, further including:

means for adjusting the foil group in the direction of the forming wire.

4. The dewatering device for the web-forming section of a papermaking machine according to claim 1, wherein:

said coupling elements comprise rigid coupling elements.

5. The dewatering device of the web-forming section of a papermaking machine according to claim 1, wherein:

said means for connecting together at least one plurality of only two, three or four of the plurality of foils together into a foil group comprises means for connecting together at least one plurality of only three of the plurality of foils together into a foil group.

6. The dewatering device for the web-forming section of a paper-making machine according to claim 1, wherein:

the coupling elements comprise pivot means for mechanically interconnecting the support members with one another.

7. The dewatering device for the web-forming section of a papermaking machine according to claim 1, wherein:

at least one of the force elements comprises a force-generating source which can be filled with a pressurized fluid medium; and the force-generating source applying a force in the direction of the forming wire which can be adjusted by the pressurized fluid medium.

8. The dewatering device for the web-forming section of a papermaking machine according to claim 1, wherein:

the force elements comprise force-generating sources which can be filled with a pressurized fluid medium; and at least one of the force-generating sources applying a force directed towards the forming wire and a further one of the force-generating sources applying a force opposite to the predetermined direction of travel of the forming wire, so that forces effective in the predetermined direction of travel of the forming wire are at least partially taken up by at least the further one of the force-generating sources.

9. The dewatering device for the web-forming section of a papermaking machine according to claim 1, wherein:

at least one of the force elements comprises a force-generating source which can be filled with a pressurized fluid medium; and said force-generating source possessing a cross-sectional configuration of elongated expanse in the predetermined direction of travel of the forming wire.

10. The dewatering device for the web-forming section of a papermaking machine according to claim 1, further including:

relatively low friction guide elements successively arranged in the predetermined direction of travel of the forming wire for applying the moment which counteracts the tilting moment.

11. The dewatering device for the web-forming section of a papermaking machine according to claim 1, wherein:

at least one of the force elements comprises a force-generating source which can be filled with a pressurized fluid medium;

the force-generating source having a rear wall, as viewed with respect to the predetermined direction of travel of the forming wire and a more forwardly situated region; and said rear wall being constructed such that, during operation of the dewatering device, said rear wall produces a stronger force in the direction of the forming wire than said more forwardly situated region of such force-generating source.

12. The dewatering device for the web-forming section of a papermaking machine according to claim 1, wherein:

the force element of an associated foil comprises at least two force-generating sources provided for each associated foil;

said at least two force-generating sources producing forces of different magnitude applied in the direction of the forming wire; and said at least two force-generating sources being successively arranged as viewed with respect to the predetermined direction of travel of the forming wire.

13. The dewatering device for the web-forming section of a papermaking machine according to claim 1, wherein:

the force element of an associated foil comprises only a single force-generating source provided for each associated foil;

said single force-generating source producing a force directed towards the forming wire and, as viewed with respect to the predetermined direction of travel of the forming wire, being situated behind a point of force application of the associated foil at the forming wire.

14. The dewatering device for the web-forming section of a papermaking machine according to claim i, wherein:

the force element of an associated foil comprises at least two force-generating sources provided for each associated foil;

one of said at least two force-generating sources producing a force which fails to extend directly towards the forming wire; and means for shifting said one of said at least two force-generating sources in the direction of the forming wire.

15. The dewatering device for the web-forming section of a papermaking machine according to claim 1, wherein:

the force element of an associated foil comprises at least two force-generating elements provided for each associated foil;

one of said at least two force-generating sources producing a force which fails to extend directly towards the forming wire; and means for freely adjusting said one of said at least two force-generating sources in the direction of the forming wire.

16. The dewatering device for the web-forming section of a paper-making machine according to claim 1, further including:

a frame member provided with said foil group;

the force elements operatively engaging with the frame member for producing the moments counteracting the tilting moments; and at least two of said force elements being arranged in succession as viewed with respect to the predetermined direction of travel of the forming wire.

17. A dewatering device for the web-forming section of a papermaking machine, comprising:

a forming wire movable in a predetermined direction of travel;

a plurality of foils cooperating with the forming wire and disposed transverse to the predetermined direction of travel of the forming wire;

force means provided for the foils for exerting, by means of the foils, a predetermined force upon the forming wire for the dewatering and formation of a paper web formed of fiber stock suspension which is located upon the forming wire;

the plurality of foils contacting the forming wire, during operation of the dewatering device, to produce frictional forces between the plurality of foils and the forming wire which exert tilting moments upon the plurality of foils;

the force means, together with means for connecting together at least one plurality of only two, three or four of the plurality of foils into a foil group, producing additional moments counteracting the tilting moments exerted by the frictional forces present between the plurality of foils and the forming wire;

support members extending transverse to the predetermined direction of travel of the forming wire;

said means for connecting together at least one plurality of only two, three or four of the plurality of foils into a foil group comprising coupling elements for mechanically interconnecting said plurality of only two, three or four of the plurality of foils in succession in the predetermined direction of travel of the forming wire and for assembling respective individual ones of the support members together to form said foil group;

guide members, each guide member structured for displaceably guiding a respective one of the support members in the direction of the forming wire;

means mounted in cooperation with at least one of the support members and with at least one of the guide members for taking up forces acting in the predetermined direction of travel of the forming wire; and said support members and said coupling elements being constructed such that there is provided a predetermined amount of free space for the throughflow of water passing through the forming wire.

18. The dewatering device for the web-forming section of a papermaking machine according to claim 17, wherein:

one of said force elements is provided for each respective one of said foils.

19. The dewatering device for the web-forming section of a papermaking machine according to claim 17, wherein:

said means for connecting together at least one plurality of only two, three or four of the plurality of foils together into a foil group comprises means for connecting together at least one plurality of only three of the plurality of foils together into a foil group.

* * * * *